US010106363B1

(12) United States Patent
Faust et al.

(10) Patent No.: US 10,106,363 B1
(45) Date of Patent: Oct. 23, 2018

(54) FLAP FOLDER

(71) Applicant: Packaging Progressions, Inc., Souderton, PA (US)

(72) Inventors: Charles Faust, Bensalem, PA (US); Andrew Ticknor, Harleysville, PA (US)

(73) Assignee: PACKAGING PROGRESSIONS, INC., Souderton, PA (US)

( * ) Notice: Subject to any disclaimer, the term of this patent is extended or adjusted under 35 U.S.C. 154(b) by 0 days.

(21) Appl. No.: 15/878,838

(22) Filed: Jan. 24, 2018

Related U.S. Application Data

(60) Provisional application No. 62/541,322, filed on Aug. 4, 2017.

(51) Int. Cl.
*B65H 45/16* (2006.01)
*B31F 1/00* (2006.01)

(52) U.S. Cl.
CPC ..... *B65H 45/167* (2013.01); *B31F 1/0019* (2013.01)

(58) Field of Classification Search
CPC ..... B65H 45/167; B31F 1/0019; B65B 7/20; B65B 7/22; B65B 11/08; B65B 11/18; B65B 49/00; B65B 49/02; B65B 49/12; B65B 49/14
USPC ..... 53/209, 220, 221, 461, 464
See application file for complete search history.

(56) References Cited

U.S. PATENT DOCUMENTS 3,293,827 A * 12/1966 Farnow ..... B65B 7/20 118/248
3,398,659 A * 8/1968 Egleston ..... B31B 50/00 493/33
3,733,980 A * 5/1973 Palmer ..... B31B 50/00 493/125
3,762,131 A * 10/1973 Christensson ..... B65B 43/50 53/282
3,810,314 A * 5/1974 Anderson ..... B65B 11/42 53/230
4,518,300 A * 5/1985 Kent ..... B26D 7/32 414/790.3
4,648,236 A * 3/1987 Knecht ..... B65B 11/40 53/234
4,742,670 A * 5/1988 Windsor ..... B65B 5/026 53/242
4,776,147 A * 10/1988 Konzal ..... B65B 61/24 156/227

(Continued)

OTHER PUBLICATIONS

International Search Report and Written Opinion for PCT Application No. PCT/US18/14983, dated Apr. 16, 2018.

*Primary Examiner* — Thanh Truong
*Assistant Examiner* — Thomas Wittenschlaeger
(74) *Attorney, Agent, or Firm* — Volpe and Koenig, P.C.

(57) ABSTRACT

A flap folding arrangement is disclosed. The flap folding arrangement includes an axially extending rim that initially contacts a flap of a product to partially fold the flap as the product is dropped from a feed conveyor into a first pocket of a rotator pan. A controller is adapted to rotate the rotator pan away from a first position which drives the flap into contact with a flap-folding flange and a radially extending rim until the product is positioned at a second position under a flap-folding gate. The controller is adapted to drive a product discharger into contact with the product to drive the product out of the first pocket and away from the folding assembly after rotation of the rotator pan.

12 Claims, 8 Drawing Sheets

(56) References Cited

U.S. PATENT DOCUMENTS

| | | | | | |
|---|---|---|---|---|---|
| 5,081,821 | A * | 1/1992 | Meives | B65B 25/14 | 271/202 |
| 5,484,102 | A * | 1/1996 | DeMay | B65D 5/5415 | 229/132 |
| 5,732,534 | A * | 3/1998 | Disrud | B65B 5/106 | 53/467 |
| 6,854,243 | B2 * | 2/2005 | Sendo | B65B 19/225 | 53/234 |
| 7,555,876 | B2 * | 7/2009 | Drenguis | B65B 11/40 | 53/206 |
| 8,266,877 | B2 * | 9/2012 | Biondi | B65B 19/24 | 53/210 |
| 9,090,366 | B2 * | 7/2015 | Draghetti | B65B 11/16 | |
| 2008/0134636 | A1 * | 6/2008 | Drenguis | B65B 11/40 | 53/234 |

* cited by examiner

FLAP FOLDER

INCORPORATION BY REFERENCE

The following document is incorporated herein by reference as if fully set forth: U.S. Provisional Application No. 62/541,322, filed Aug. 4, 2017.

FIELD OF THE INVENTION

The invention is generally related to a conveyor arrangement, and is more specifically related to a flap folder for a conveyor arrangement.

BACKGROUND

It is well known to use conveyors to direct products with respect to an assembly line. Products can be placed on substrates, such as packaging, wrapping, wax paper, or other material. After the products are placed on the substrate to form a product-substrate combination, subsequent folding of a flap of the substrate is typically required for further processing of the product. It is time consuming and expensive to manually fold the flaps of the substrates, and it would be desirable to provide an automated and reliable solution for folding these flaps.

SUMMARY

A flap folding arrangement with an improved folding configuration for folding a flap of a substrate over a product is disclosed. The arrangement includes a feed conveyor configured to move a product located on a substrate having a flap at its trailing edge to a discharge end of the feed conveyor. A folding assembly is provided that includes a frame, and a rotator pan mounted to the frame for rotation about a vertical axis. The rotator pan has a first pocket and is rotatable from a first position in which the first pocket is aligned with the discharge end of the feed conveyor for receiving the product to a second position aligned with a product discharge. The folding assembly includes an axially extending rim that extends from the frame about a circumferential edge of the rotator pan. A flap-folding flange is connected to the axially extending rim at a position offset from the discharge end of the feed conveyor in a rotational direction of the rotator pan. A radially extending rim extends along the axially extending rim from the flap-folding flange to the second position. A flap-folding gate is movable between open and closed positions to discharge the product with the flap folded over the product, and the flap-folding gate is arranged at the second position of the rotator pan and aligned with the product discharge. A product discharger is configured to drive the product out of the first pocket towards a receiving conveyor. The axially extending rim initially contacts the flap of the product to partially fold the flap as the product is dropped from the feed conveyor into the first pocket. A controller is adapted to rotate the rotator pan away from the first position which drives the flap into contact with the flap-folding flange and the radially extending rim until the product is positioned at the second position under the flap-folding gate. The controller is also adapted to drive the product discharger into contact with the product to drive the product out of the first pocket and away from the folding assembly after rotation of the rotator pan.

Further details of the invention are explained in detail below and in the claims.

BRIEF DESCRIPTION OF THE DRAWINGS

The foregoing summary as well as the following detailed description will be better understood when read in conjunction with the appended drawings. For the purposes of illustrating the invention, there is shown in the drawings an embodiment which is presently preferred. It should be understood, however, that the invention is not limited to the precise arrangement shown. In the drawings.

DETAILED DESCRIPTION OF THE PREFERRED EMBODIMENTS

Figure 1:
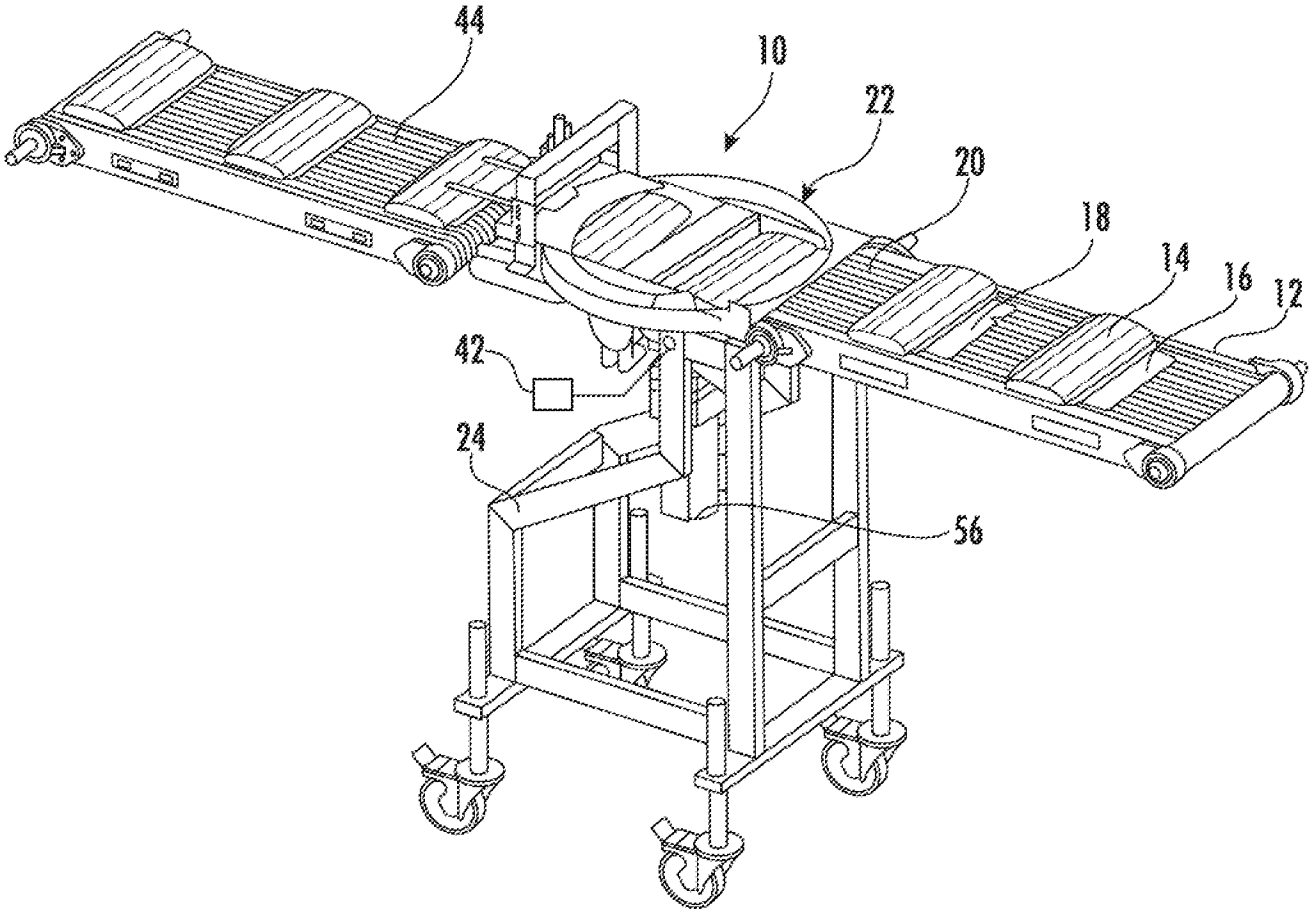
FIG. 1 is a perspective view of a flap folding arrangement according to one embodiment.

Certain terminology is used in the following description for convenience only and is not considered limiting. Words such as "left", "right", "front", "back", "top", and "bottom" designate directions in the drawings to which reference is made. This terminology includes the words specifically noted above, derivatives thereof, and words of similar import. Additionally, the terms "a" and "one" are defined as including one or more of the referenced item unless specifically noted. Additionally, a group of items referred to as "at least one of a, b, or c," refers to any one of a, b, or c, or combinations thereof.

As shown in FIGS. 1-8, a flap folding arrangement 10 is illustrated. The flap folding arrangement 10 includes a feed conveyor 12 configured to move a product 14 located on a substrate 16 having a flap 18 at its trailing edge to a discharge end 20 of the feed conveyor 12. The flap folding arrangement 10 includes a folding assembly 22 with a frame 24. A rotator pan 26 is mounted to the frame 24 for rotation about a vertical axis. The rotator pan 26 includes a first pocket 28 configured to receive the product 14, and is rotatable from a first position in which the first pocket 28 is aligned with the discharge end 20 of the feed conveyor 12 for receiving the product 14 to a second position aligned with a product discharge 30. The flap folding arrangement 10 preferably includes a receiving conveyor 46 configured to receive the product 14 being discharged from the folding assembly 22. One of ordinary skill in the art would recognize that the product discharge 30 can include an additional conveyor, packaging apparatus, or any other known type of discharge arrangement.

An axially extending rim 32 extends from the frame 24 about a circumferential edge of the rotator pan 26. A flap-folding flange 34 is connected to the axially extending rim 32 at a position offset from the discharge end 20 of the feed conveyor 12 and in a rotational direction of the rotator pan 26. A radially extending rim 36 extends along the axially extending rim 32 from the flap-folding flange 34 to the second position of the rotator pan 26. The radially extending rim 36 circumferentially extends until a flap-folding gate 38, which is movable between open and closed positions to discharge the product 14 with the flap 18 folded over the product 14. The flap-folding gate 38 is arranged at the second position of the rotator pan 26 and is aligned with the product discharge 30. The flap-folding gate 38 is rotationally fixed to the frame 24. A product discharger 40 is configured to drive the product 14 out of the first pocket 28.

Figure 2:
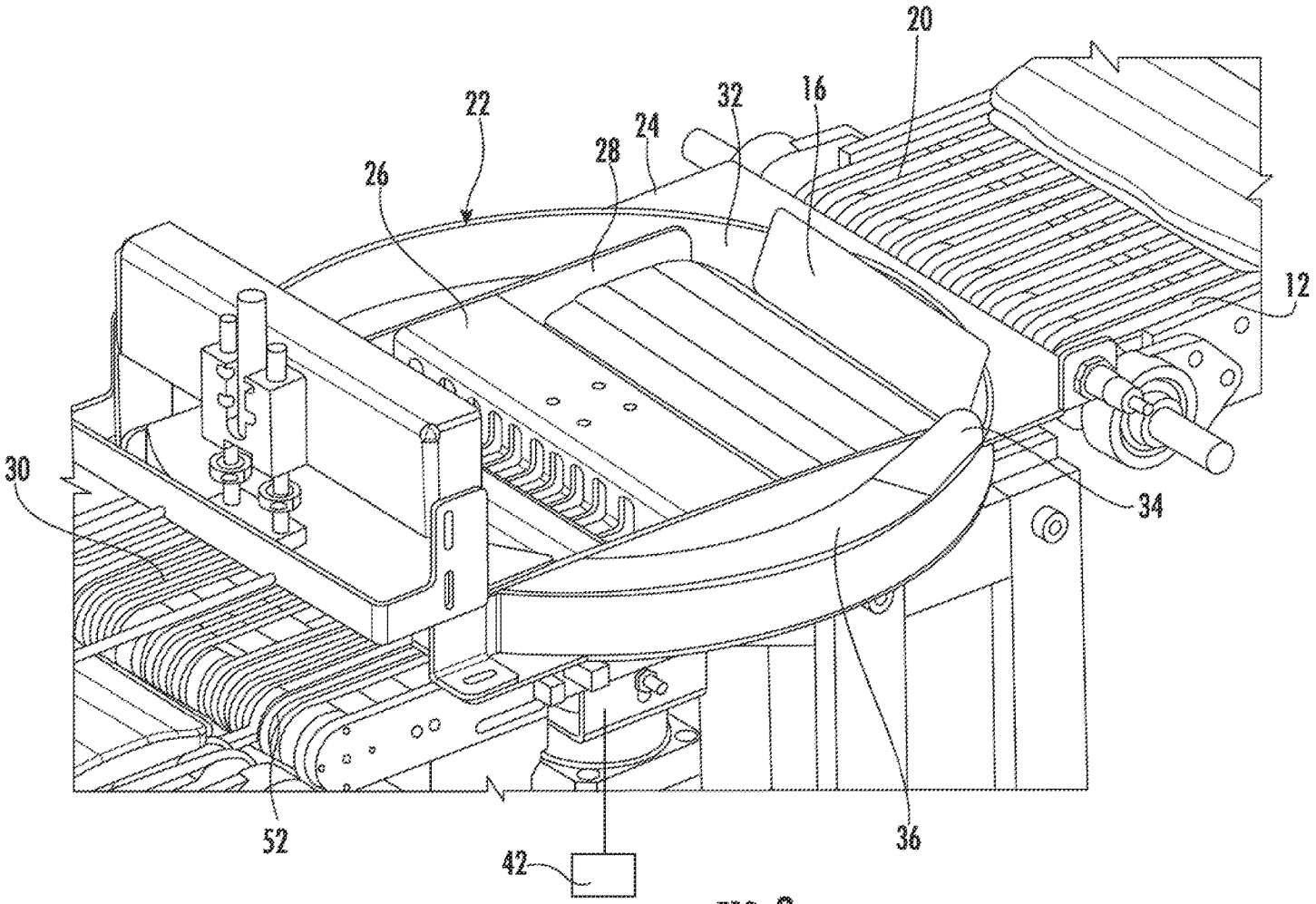
FIG. 2 is a perspective view of a folding assembly and a rotator pan of the flap folding arrangement as a product drops into a first pocket of the rotator pan.
Figure 3:
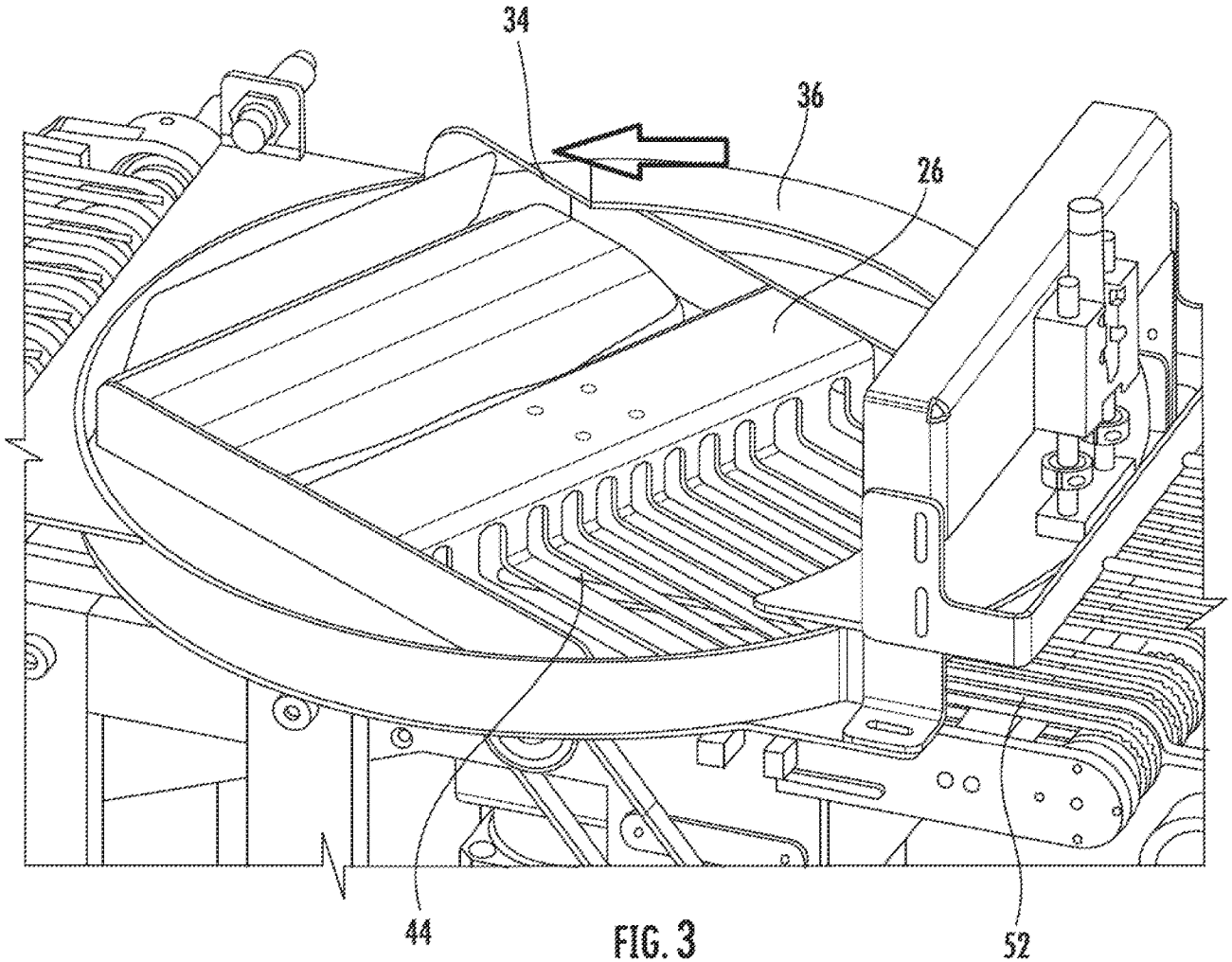
FIG. 3 is a perspective view of the rotator pan starting to rotate after the product drops into the rotator pan.
Figure 4:
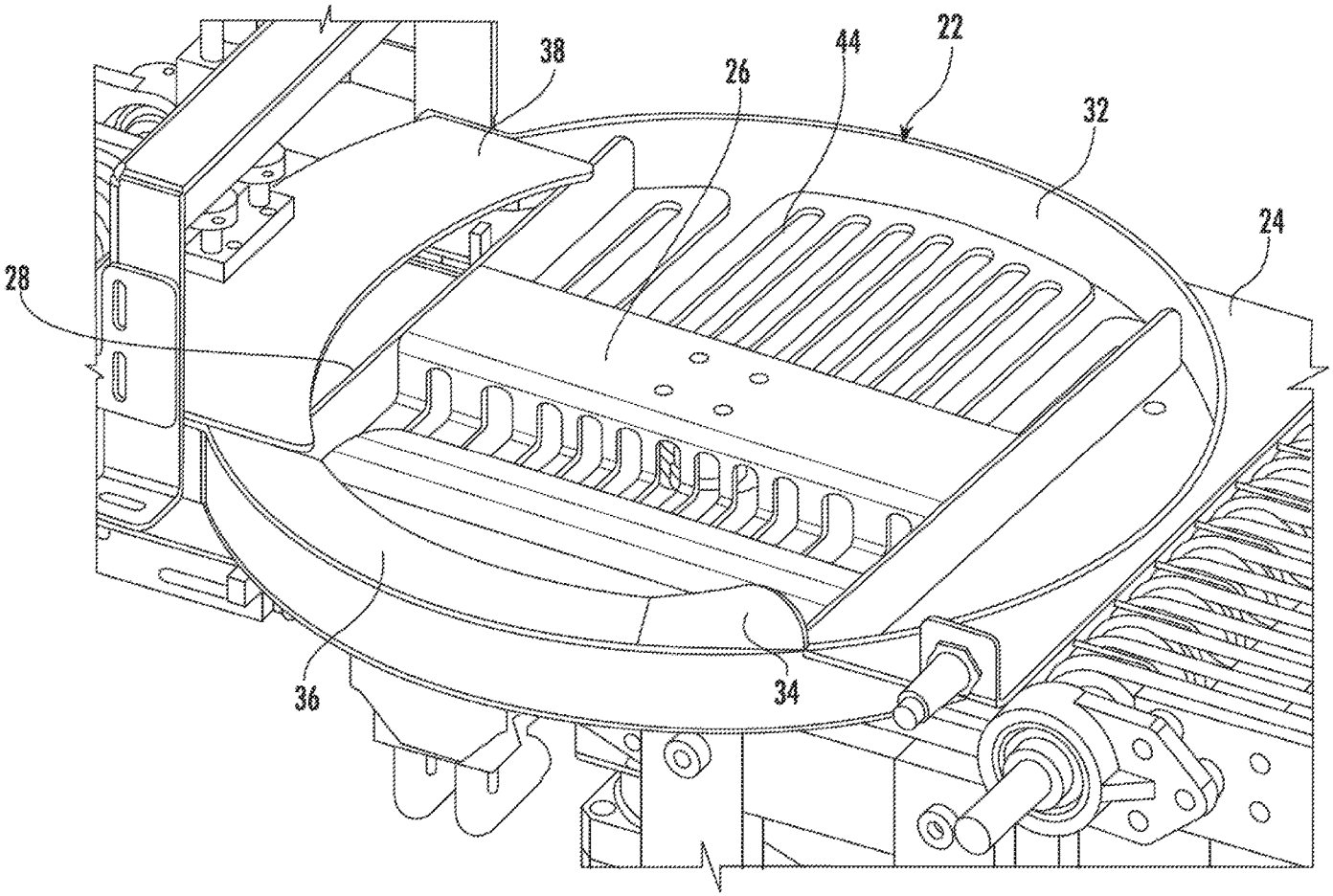
FIG. 4 is a perspective view of the rotator pan during rotation.
Figure 5:
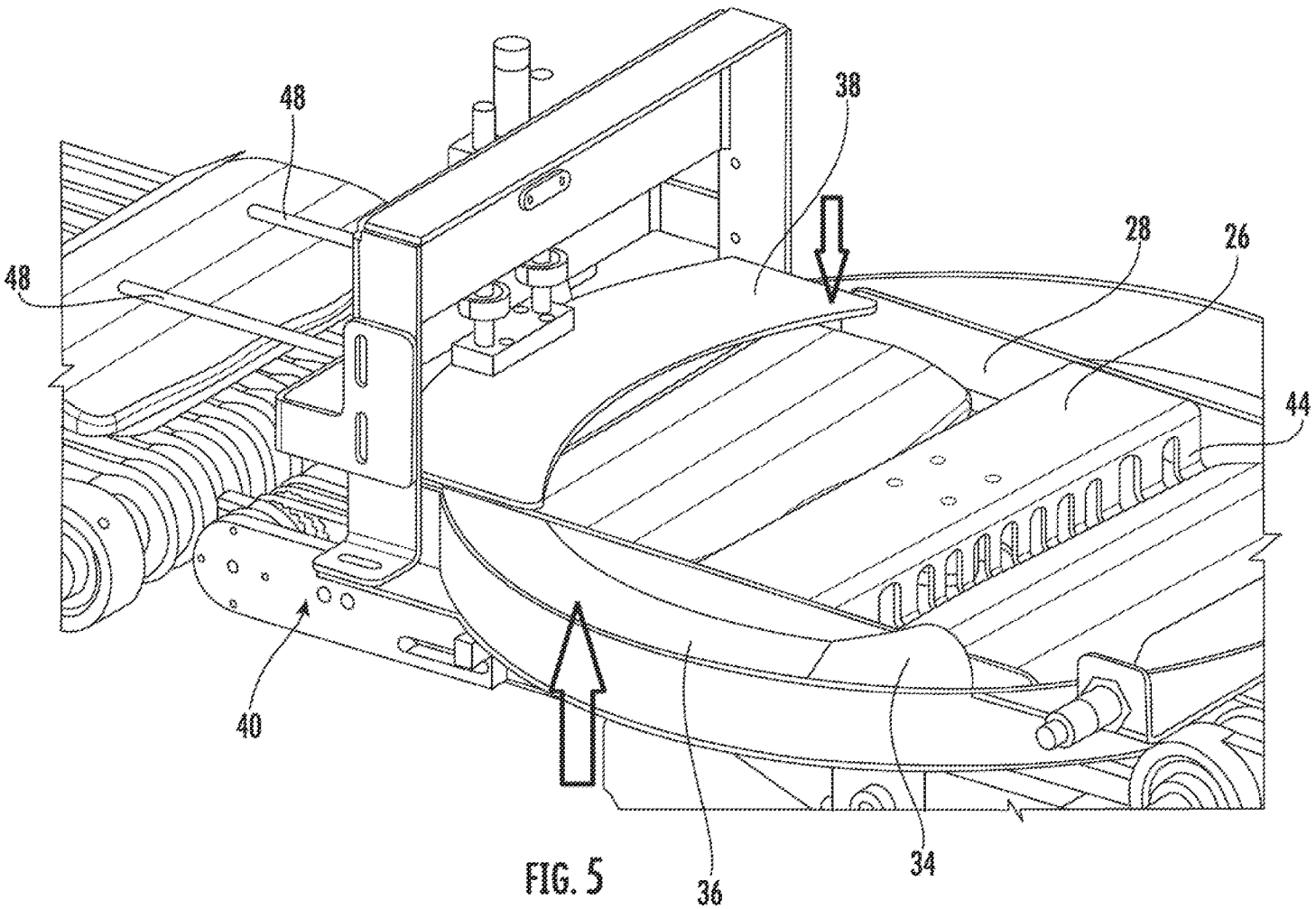
FIG. 5 is a perspective view of the folding assembly with a flap-folding gate in a closed position engaging the product.
Figure 6:
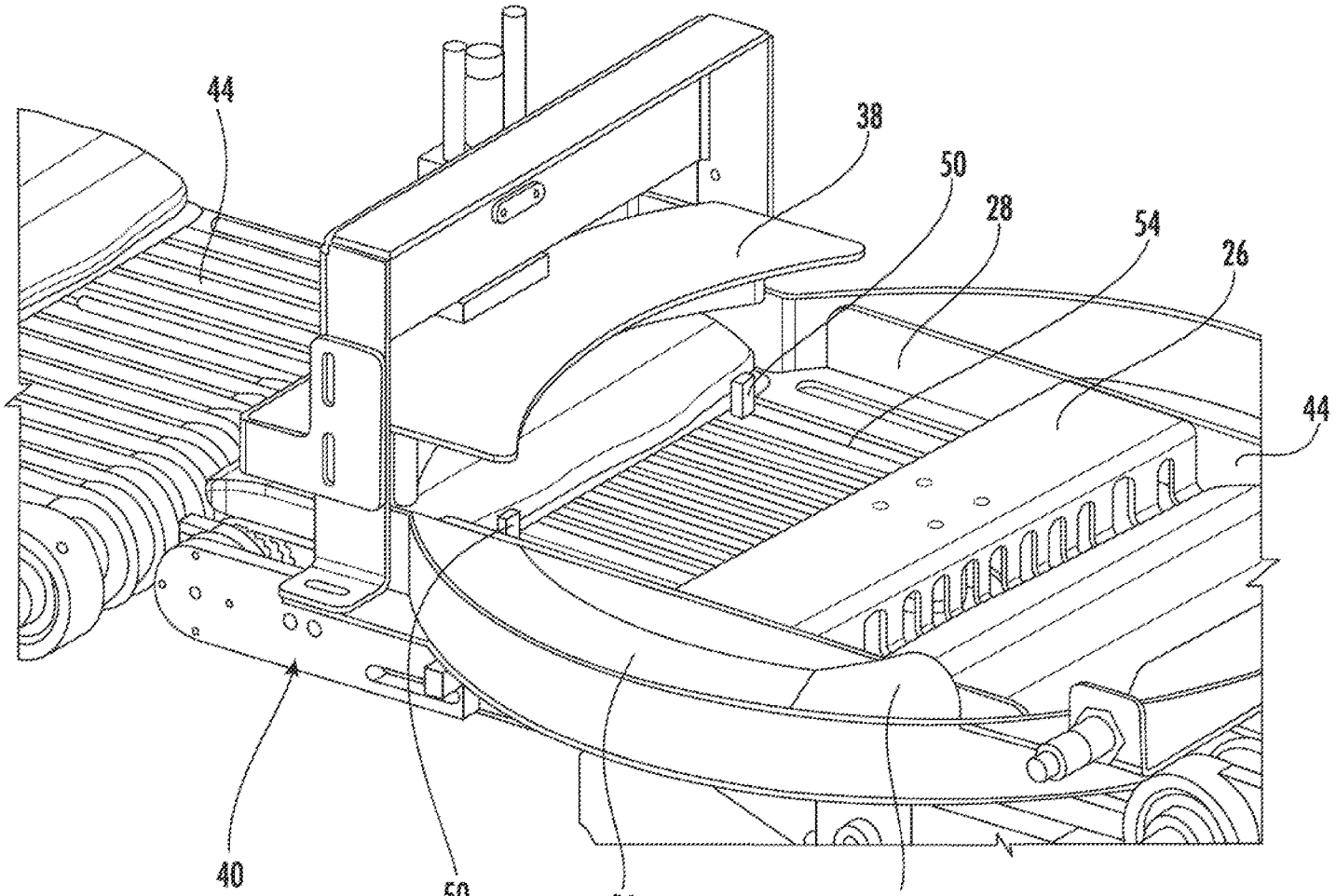
FIG. 6 is a perspective view of the folding assembly with the flap-folding gate in an open position and the product being discharged from the folding assembly.

As shown in FIG. 2, the axially extending rim 32 initially contacts the flap 18 of the product 14 to partially fold the flap 18 as the product 14 is dropped from the feed conveyor 12 into the first pocket 28. The axially extending rim 32 folds the flap 18 by approximately 90°. A controller 42 (shown schematically in FIGS. 1 and 2) is adapted to rotate the rotator pan 26 away from the first position which drives the flap 18 into contact with the flap-folding flange 34 of the stationary frame 24 and the radially extending rim 36 until the product 14 is positioned at the second position under the flap-folding gate 38, as shown sequentially in FIGS. 2-5. A height of the flap-folding gate 38 and a height of the radially extending rim 36 are identical during rotation of the rotator pan 26. This arrangement assures that the flap 18 maintains its fold when the product 14 moves from the radially extending rim 36 to the flap-folding gate 38. After the product 14 is positioned under the flap-folding gate 38, then the flap-folding gate 38 moves to an open position, shown in FIG. 6, to allow the product 14 to be discharged. The controller 42 is adapted to drive the product discharger 40 into contact with the product 14 to drive the product 14 out of the first pocket 28 and away from the folding assembly 22 after rotation of the rotator pan 26, as shown in FIG. 6. The product 14 exits the folding assembly 22 with the folded flap 18 at its leading edge. A motor 56 is illustrated in FIG. 1 which is used to drive rotation of the rotator pan 26. The motor 56 can be used to drive rotation of the conveyors or any other components of the arrangement 10. One of ordinary skill in the art would recognize from the present disclosure that other types of control electronics, motors, or drives can be used to operate the conveyors, rotator pan, and any other components of the arrangement 10.

As shown in the drawings, the rotator pan 26 includes a second pocket 44. The second pocket 44 is configured to receive an additional product, simultaneously as the first pocket 28 includes the product 14. The second pocket 44 has the same function and configuration as the first pocket 28 and provides an improved arrangement for folding the flap 18 over the product 14. The second pocket 44 is preferably arranged on a diametrically opposite side of the rotator pan 26 from the first pocket 28. According to this arrangement, multiple products can be processed simultaneously. The rotator pan 26 preferably rotates 180° to align the first pocket 28 with the feed conveyor 12 in the first position, and 180° rotation of the rotator pan 26 aligns the first pocket 28 with both the flap-folding gate 38 and the receiving conveyor 44 in the second position.

Figure 7:
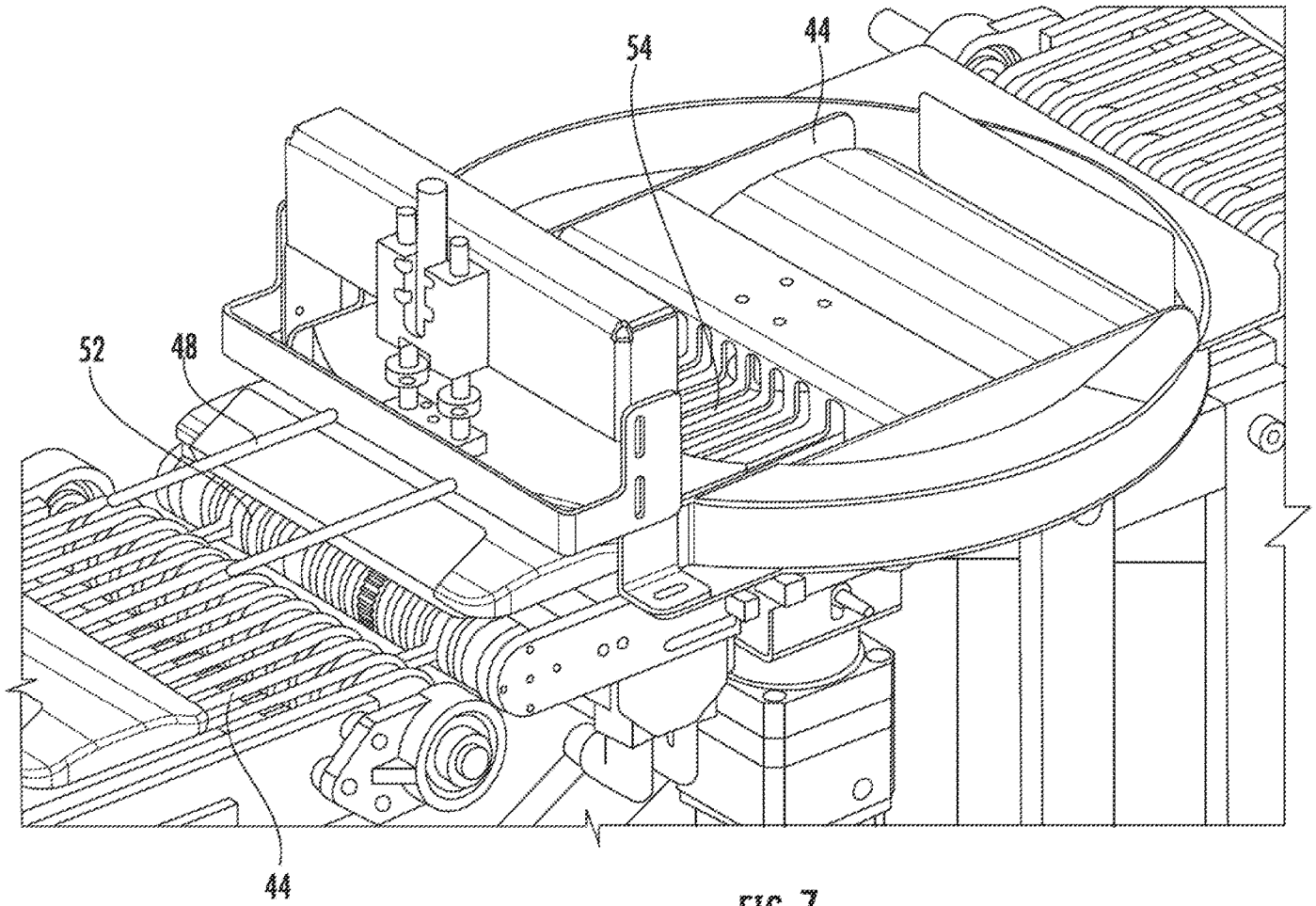
FIG. 7 is a perspective view of the folding assembly as the product is discharged onto a receiving conveyor and an product is received by a second pocket.

The folding assembly 22 includes at least one guide 48 that extends in a discharge direction from the folding assembly 22, which is shown most clearly in FIG. 7. The at least one guide 48 can include any type of folding guide surface for maintaining a fold of the flap 18 over the product 14. The at least one guide 48 is illustrated as two bars in the drawings, but one of ordinary skill in the art would recognize from the present disclosure that alternative types of guides could be used. The at least one guide 48 folds the flap 18 of the product 14 as the product 14 is discharged from the folding assembly 22 and transported towards the receiving conveyor 44.

Figure 8:
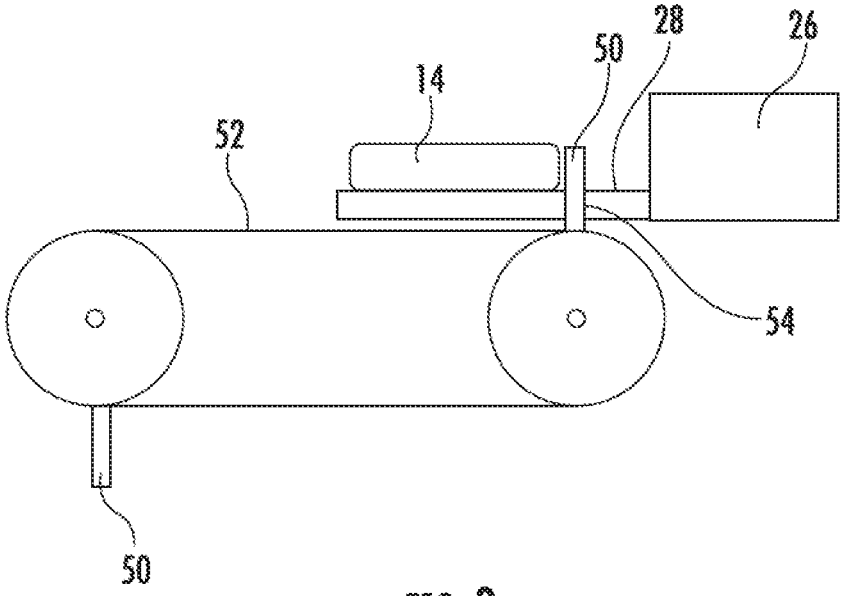
FIG. 8 is a schematic view of a product discharge conveyor.

In one embodiment, the product discharger 40 includes a plurality of flights 50 arranged on a product discharging conveyor 52. This arrangement is shown most clearly in FIG. 8, which is a schematic representation of the product discharging conveyor 52 and the flights 50. The plurality of flights 50 preferably extend through slots 54 defined by the first pocket 28, shown most clearly in FIG. 6. The plurality of flights 50 are arranged below the first pocket 28 as the rotator pan 26 rotates. The plurality of flights 50 are arranged on the product discharging conveyor 52 and the flights 50 are driven according to a controlled interval such that the flights 50 do not obstruct or block the rotation of the rotator pan 26. The flights 50 only extend through the slots 54 of the pocket 28 when the product 14 is within the pocket 28 and ready to be discharged. As shown in FIG. 8, two pairs of the flights 50 are provided. One of ordinary skill in the art would recognize from the present disclosure that this process can be controlled by a motor, sensor, timer, controller, or any other known control system. A sensor can be implemented in any of the regions of the flap folding arrangement 10, for example to detect the presence of product 14 within the pocket 28 of the rotator pan 26.

The feed conveyor 12 is preferably arranged above first pocket 28 of the folding assembly 22. The first pocket 28 of the folding assembly 22 is arranged at the same height or above the receiving conveyor 44. This gradual downward progression from the feed conveyor 12 down to the rotator pan 26 to the receiving conveyor 44 allows the product 14 to reliably and smoothly be transported through the flap folding arrangement 10.

Having thus described various embodiments of the present flap folding arrangement in detail, it is to be appreciated and will be apparent to those skilled in the art that many changes, only a few of which are exemplified in the detailed description above, could be made in the flap folding arrangement without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A flap folding arrangement comprising:

a feed conveyor configured to move a product located on a substrate having a flap at its trailing edge to a discharge end of the feed conveyor; and a folding assembly including:

a frame, a rotator pan mounted to the frame for rotation about a vertical axis, the rotator pan having a first pocket and being rotatable from a first position in which the first pocket is aligned with the discharge end of the feed conveyor for receiving the product to a second position aligned with a product discharge, an axially extending rim extends from the frame about a circumferential edge of the rotator pan, a flap-folding flange connected to the axially extending rim at a position offset from the discharge end of the feed conveyor in a rotational direction of the rotator pan, a radially extending rim that extends along the axially extending rim from the flap-folding flange to the second position, a flap-folding gate that is movable between open and closed positions to discharge the product with the flap folded over the product, the flap-folding gate is arranged at the second position of the rotator pan aligned with the product discharge, and a product discharger configured to drive the product out of the first pocket;

the axially extending rim initially contacts the flap of the product to partially fold the flap as the product is dropped from the feed conveyor into the first pocket;

a controller is adapted to rotate the rotator pan away from the first position which drives the flap into contact with the flap-folding flange and the radially extending rim until the product is positioned at the second position under the flap-folding gate, and the controller is adapted to drive the product discharger into contact with the product to drive the product out of the first pocket and away from the folding assembly after rotation of the rotator pan.

2. The flap folding arrangement of claim 1, wherein the rotator pan includes a second pocket, and the second pocket is configured to receive an additional product.

3. The flap folding arrangement of claim 2, wherein the second pocket is arranged on a diametrically opposite side of the rotator pan from the first pocket.

4. The flap folding arrangement of claim 1, further comprising a receiving conveyor configured to receive the product being discharged from the folding assembly.

5. The flap folding arrangement of claim 1, wherein the flap-folding gate is rotationally fixed.

6. The flap folding arrangement of claim 1, wherein a height of the flap-folding gate and a height of the radially extending rim are identical during rotation of the rotator pan.

7. The flap folding arrangement of claim 1, wherein the rotator pan rotates 180° to align the first pocket with the discharge end of the feed conveyor in the first position, and rotation of the rotator pan aligns the first pocket with the flap-folding gate and a receiving conveyor in the second position.

8. The flap folding arrangement of claim 1, wherein the folding assembly includes at least one guide extending in a discharge direction from the folding assembly, the at least one guide folds the flap of the product as the product is discharged from the folding assembly towards a receiving conveyor.

9. The flap folding arrangement of claim 1, wherein the product discharger includes a plurality of flights arranged on a product discharging conveyor.

10. The flap folding arrangement of claim 9, wherein the plurality of flights extend through slots defined by the first pocket.

11. The flap folding arrangement of claim 9, wherein the plurality of flights are arranged below the first pocket as the rotator pan rotates.

12. The flap folding arrangement of claim 1, further comprising a receiving conveyor, wherein the feed conveyor is arranged above the first pocket of the folding assembly, and the first pocket of the folding assembly is arranged above the receiving conveyor.

* * * * *